US007112080B2

(12) United States Patent
Nicholson

(10) Patent No.: US 7,112,080 B2
(45) Date of Patent: Sep. 26, 2006

(54) WET MATEABLE CONNECTOR

(75) Inventor: Allan Nicholson, Barrow in Furness (GB)

(73) Assignee: Diamould Limited, Barrow-in-Furness (GB)

( * ) Notice: Subject to any disclaimer, the term of this patent is extended or adjusted under 35 U.S.C. 154(b) by 231 days.

(21) Appl. No.: 10/473,981

(22) PCT Filed: Mar. 14, 2002

(86) PCT No.: PCT/GB02/01205

§ 371 (c)(1),
(2), (4) Date: Dec. 16, 2003

(87) PCT Pub. No.: WO02/082590

PCT Pub. Date: Oct. 17, 2002

(65) Prior Publication Data

US 2005/0042903 A1 Feb. 24, 2005

(30) Foreign Application Priority Data

Apr. 4, 2001 (EP) ..... 01303193

(51) Int. Cl.
*H01R 13/52* (2006.01)

(52) U.S. Cl. ..... 439/283

(58) Field of Classification Search ..... 439/138, 439/140, 141, 199, 271, 283
See application file for complete search history.

(56) References Cited

U.S. PATENT DOCUMENTS 4,142,770 A * 3/1979 Butler et al. ..... 439/140
4,192,569 A * 3/1980 Mucci ..... 439/204
5,358,418 A 10/1994 Carmichael ..... 439/190
5,645,438 A 7/1997 Cairns ..... 439/139
5,899,765 A * 5/1999 Niekrasz et al. ..... 439/201
6,332,787 B1 * 12/2001 Barlow et al. ..... 439/138
6,511,335 B1 * 1/2003 Rayssiguier et al. ..... 439/191

FOREIGN PATENT DOCUMENTS

EP 0 251 655 1/1988

* cited by examiner

*Primary Examiner*—Tho D. Ta
*Assistant Examiner*—Larisa Tsukerman
(74) *Attorney, Agent, or Firm*—Wayne I. Kanak; Dykema Gossett PLLC

(57) ABSTRACT

An electrical connector, for use in underwater applications. The connector comprises a male component having a least one contact pin and a female component having a contact module. The male and female components engage, in use, to form a watertight electrical connection between the at least one contact pin and the contact module. The female component further comprises a biassing module, which comprises a first biassing means and a second biassing means. The first biassing means is located radially within the second biassing means with respect to the longitudinal axis of the female component. The first biassing means such that the biassing strength of the biassing module can be tailored to control the insertion rate of the male connector during coupling of the male component to the female component accommodating large variations in axial engagement length.

13 Claims, 13 Drawing Sheets

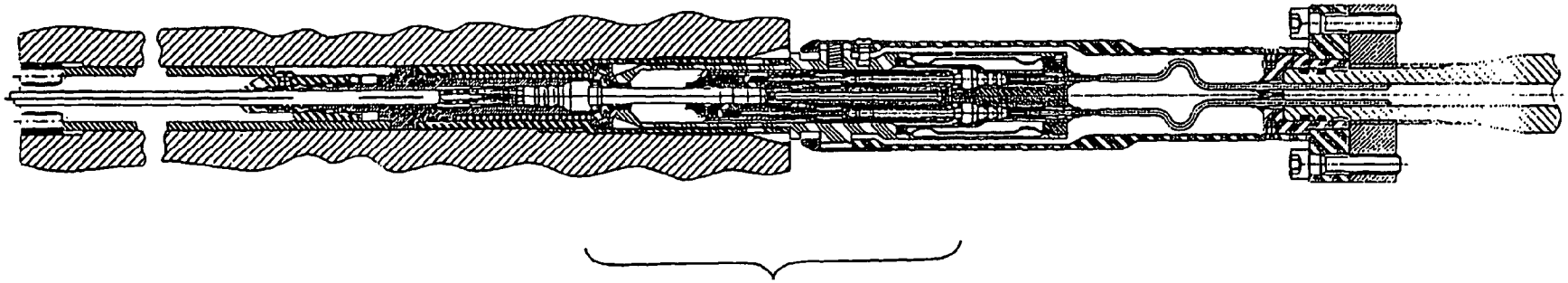
Figure 11
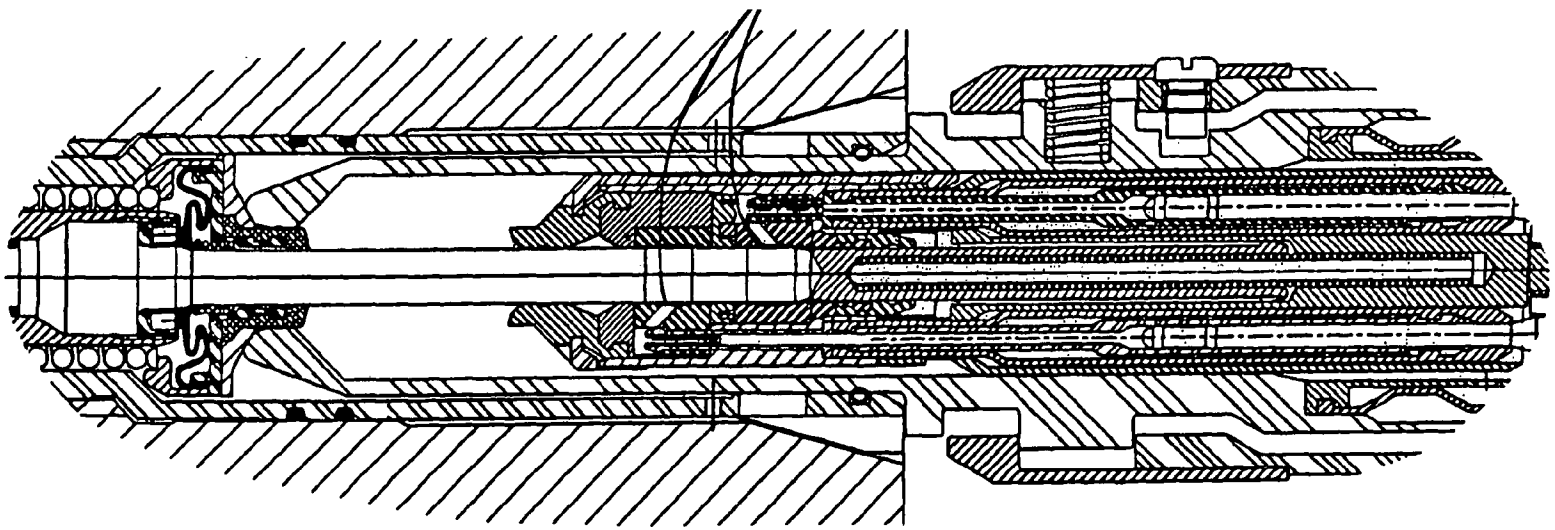

WET MATEABLE CONNECTOR

The present invention relates to the field of electrical connectors for use with sub-sea wellhead equipment but could equally be applied to sub-sea power and control applications. Equipment associated with sub-sea wellheads experience high pressures and temperatures during continuous operation. Electrical connectors of this type form pressure barriers across the wellhead components and are subject to these same severe operation parameters.

Conventional sub-sea wellheads comprise a number of large operational steel assemblies which form a pressure enclosure yet allow the wellhead to be deployed in sections and work-over operations to be carried out in service. The wellhead sections form sub assemblies which provide the interface points for the electrical and hydraulic feed through systems. Due to the operational requirements of these wellheads, there exists, a need for the electrical and hydraulic connectors to accommodate large variations in the relative positions of the wellhead parts, which form these connector interfaces. As wellheads are deployed in more aggressive deeper locations, the need for more reservoir data increases, therefore there is a drive towards more space saving couplers and devices.

Subsea wet mateable connectors are known in wellhead applications where the electrical connection is made up in an oil filled pressure balanced environment, and where a shuttle pin or sprung stopper provides a means of sealing the opening for the male contact. However, due to the nature of these connectors, a problem exists whereby the connection contacts vary in position to accommodate the relative positions in the wellhead and can result in loss of continuity and lower performance due to the precise requirements of the connection point in such connectors.

Connectors are known whereby the front contact part is sprung loaded and the cables are formed as a coiled spring to allow large variations in engagement length. This arrangement is not ideal as it can result in the connectors standing off from each other and the contacts not engaging properly. The cable coil arrangement also takes up space allowing fewer services to be provided through the wellhead.

The need to have an increased amount of instrumentation on sub-sea equipment, particularly with requirements for "intelligent wells", has lead to a need for more compact and space saving electrical couplers, whilst retaining the ability to accommodate large tolerances in connection height within the small diametral space envelope that is usually required in the sub-sea wellhead environment. Current connectors fail to provide this.

Additionally, it is known that in some circumstances the male connector can be exposed for up to 1 year in a sub-sea well without protection and that current connectors require solder terminations to be performed on the drill floor. The proposed invention provides a means by which the male contacts are continuously protected and the cable termination is simplified.

Accordingly a connector is required that is simpler to assemble and use than those in current use, whilst providing adequate protection of its internal components from the harsh sub-sea and wellhead environment,—yet accommodating a significant level of tolerance in the longitudinal and axial directions.

According to the present invention there is provided an electrical connector, for use in underwater applications, the connector comprising a male component having at least one contact pin and a female component having a contact module. The male and female components engaging, in use, to form a watertight electrical connection between the at least one contact pin and the contact module, the female component further comprising a biassing module, the biassing module comprising a first biassing means and a second biassing means, the first biassing means having a different resilience to that of the second biassing means such that the biassing strength of the biassing module can be tailored to control the insertion rate of the male connector during coupling of the male component to the female component.

One or more of the biassing means may be springs and the contact module and the biassing module may be located within an oil-filled chamber. The first biassing means may be located radially within the second biassing means with respect to the longitudinal axis of the female component. The contact module may be a slideable unit which, in use, is seated on the tip of the contact pin. The male component may further comprise a wiper assembly. The wiper assembly, in use, provides a seal between the contact pin and the contact module, whilst assisting with the axial alignment of the components during engagement. The wiper assembly may be filled with electrically insulating grease and may telescope in length.

At least one of the contact pins or contact module sliding contact elements may, in use, be connected to a cable by a crimping assembly, where the crimping assembly may latch and lock upon insertion of a cable sealing boot. The element is crimped by movement of a sealing boot which is associated therewith.

The electrical connector may form a single or dual electrical contact between the contact pin and the contact module. When the electrical contact is a dual contact the contact pin may be formed from two conducting sections which are insulated from one another, the first section lying inside the second section.

The contact module may float radially within the housing unit of the female component and can be centralised by a biassing means to compensate for radial misalignment. Furthermore, three retaining members may be located in the housing unit to permanently engage the contact housing such that torsional strain may be prevented within the female component.

Examples of the present invention will now be described with reference to the accompanying drawings, in which:

FIG. 11 shows a cross sectional view of a fully engaged dual contact sub-sea electrical connector.

Figure 1A:
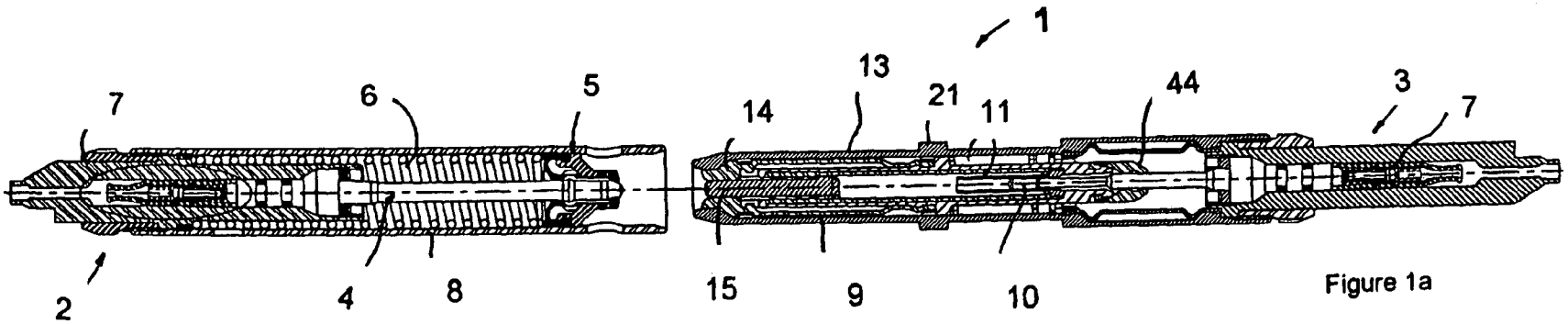
FIG. 1 shows a cross sectional view of three stages of engagement of a single contact, sub-sea, electrical connector of the present invention.

An electrical connector 1 according to the present invention is illustrated in FIG. 1. A male component 2 of the connector 1 comprises a contact pin 4, a wiper assembly 5, a wiper spring seal mechanism 6, a cable termination module 7, and an outer housing unit or alignment sleeve 8. A female component 3 comprises a sliding contact module 9 within a housing unit 13. The contact module 9 comprises at least one sliding contact pin 10, a shuttle pin 15, a biassing module 11, a cable termination module 7 and a wiper diaphragm seal 14.

Figure 1B:
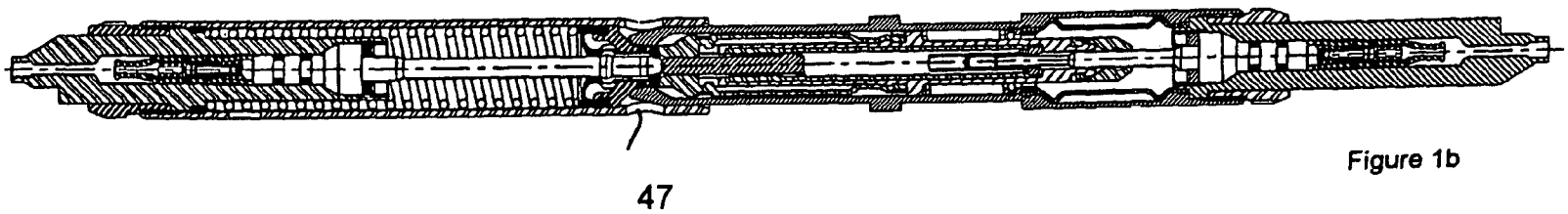
Figure 1C:
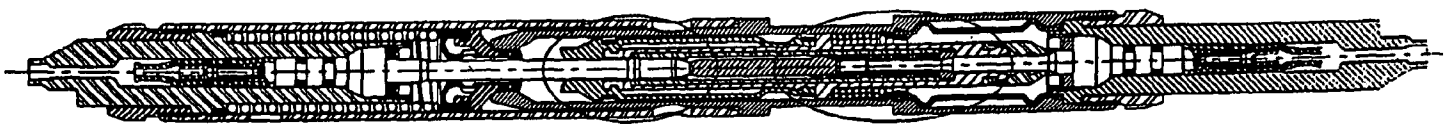

FIG. 1*a* to 1*c* shows the connector mating sequence. As the connectors are brought together alignment sleeve 8 centralises and aligns the plug nose housing 13 ejecting sand/silt and water through ports 47.

Since the wiper seal spring 6 is pre-set to a higher load than contact module return spring 11*b*, wiper seal assembly 5 enters housing 13 to form a seal between male and female components 2, 3. The contact module 9 and shuttle pin assembly 15 are driven back along the sliding contact pin 10.

Further engagement allows the shuttle pin 15 to be driven back without moving contact module assembly 9 due to the different spring settings. As the shuttle pin 15 strikes an end stop tube 43 the contact module 9 is then able to travel further along the sliding contact pin 10, thus allowing longitudinal tolerances to be accommodated.

FIG. 1*c* shows the components in their fully engaged state where the male pin 4 is fully deployed into contact module 9.

Figure 2:
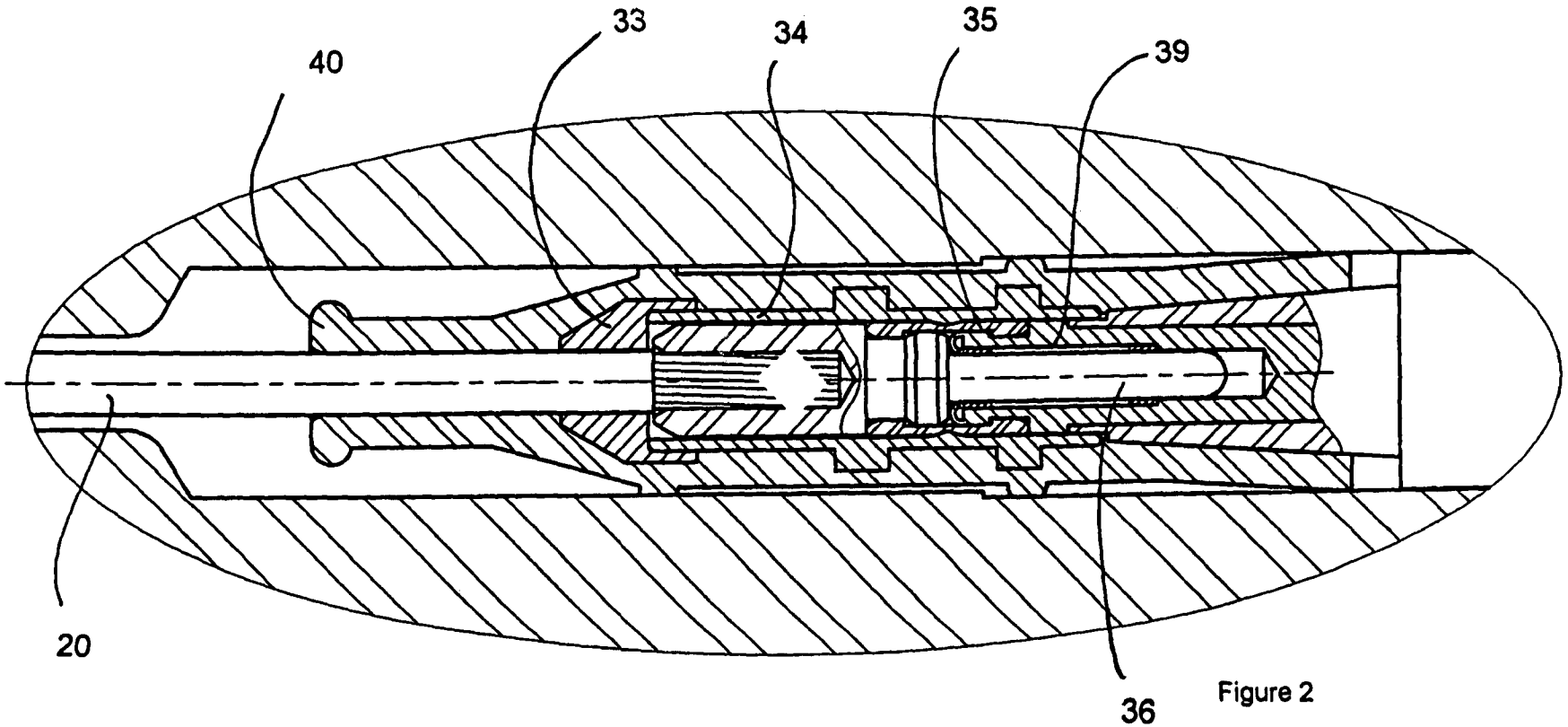
FIG. 2 illustrates the cable termination module from FIG. 1*a* in greater detail.

Both male and female connectors are terminated to cable 20 by means of a self locking and latching crimp termination element 7. The cable termination is by means of a self locking and latching crimp termination method, which will now be described. FIG. 2 shows the elements of the termination module 7 which comprises; a terminal socket contact 39, a boot seal 40, an anti extrusion cap 33, a locking tube 34, a latching tube 35, and a crimping contact 36. The latching tube 35 is slotted and is attached to the terminal contact housing. In use, the cable 20 is fed through the boot assembly 40 which is an elastomer moulding. The cable end is then prepared to allow a crimp contact 36 to be fitted to it. The crimp contact 36 is then pushed into the terminal latching tube 35, which grips around the crimp contact profile. The boot seal 40 is then slid along the cable to lock and seal the terminal in place. In the current example, the locking tube 34 is made from a rigid electrical insulation material which envelops the terminal copper elements providing good electrical insulation characteristics at elevated temperatures. This feature eliminates the need to perform skilled soldering at an installation site during the cable attachment process.

Figure 3:
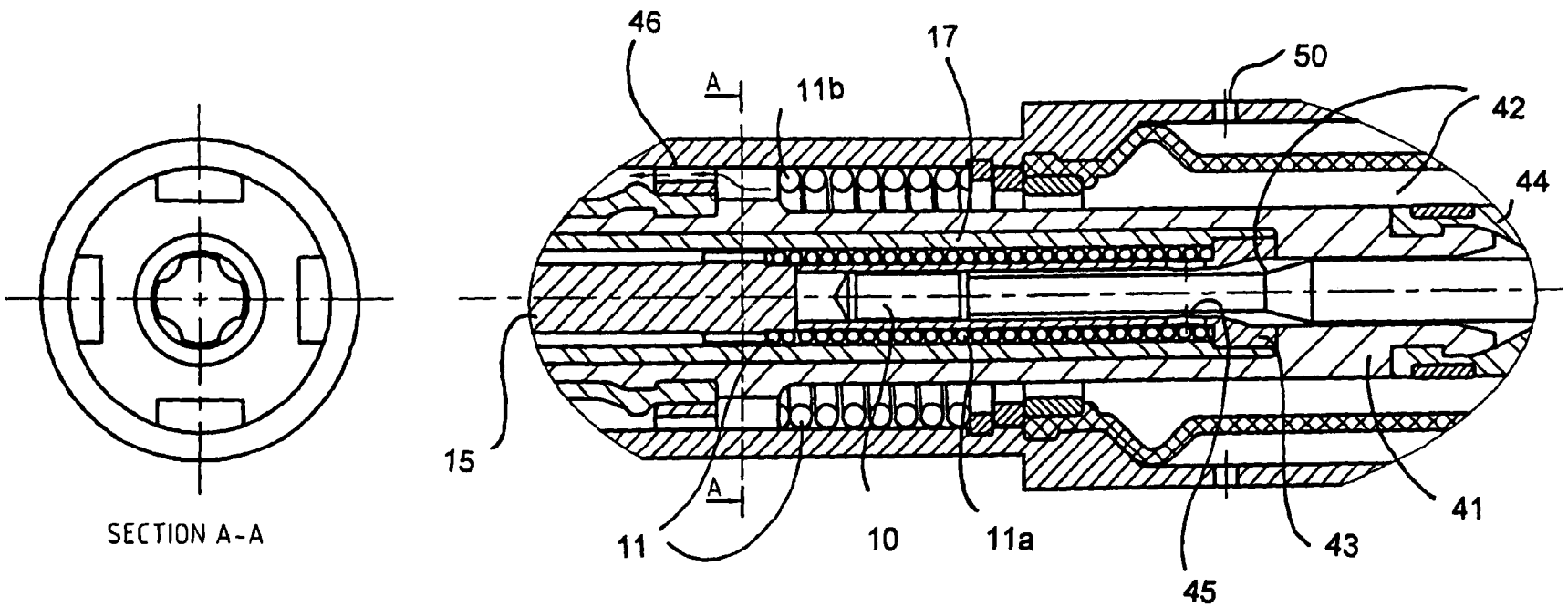
FIG. 3 illustrates the sliding contact module from FIG. 1*c* in greater detail.
Figure 4:
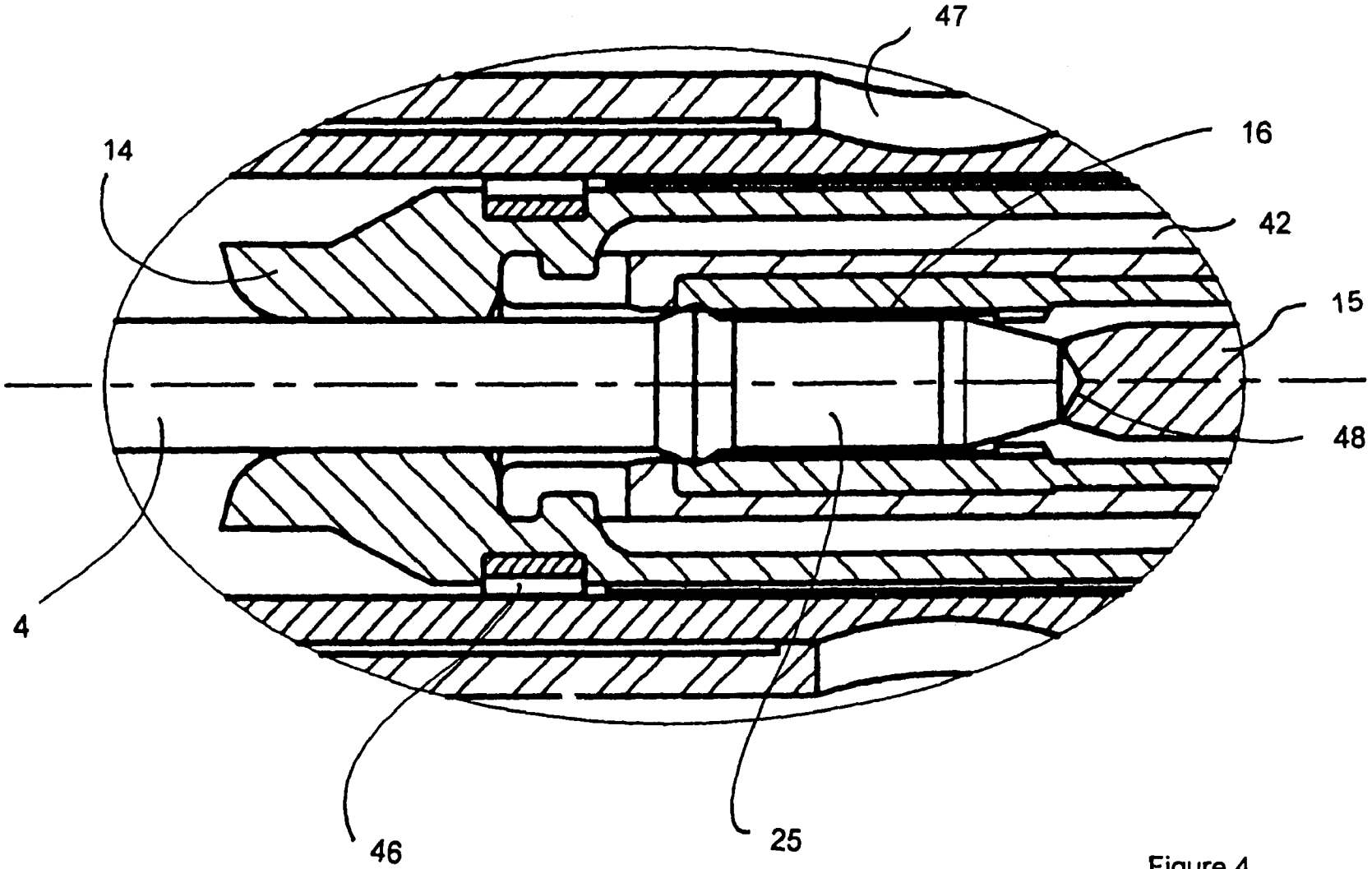
FIG. 4 illustrates the contact between the engaged male and female components from FIG. 1*c* in greater detail.

FIGS. 3 and 4 illustrate the sliding contact module in greater detail. The sliding contact module 9 comprises a central metallic contact tube element 17 formed inside an electrical insulator 41. Wiper diaphragm seal 14 is oil 42 filled and provides a pressure compensation means to allow free movement of the sliding contact module 9 and central shuttle pin 15. A reverse tube element 43 provides a sliding contact arrangement with contact pin 10 the opening for which is sealed by wiper seal 44. The reverse tube element 43 also acts as a dead stop for shuttle pin 15 and supports spring 11*a*. Dielectric oil passages 45 are provided in the reverse tube element 43 to allow oil 42 to be displaced as the sliding contact module 9 reciprocates during connection on vented bearing rings 46.

When the components 2, 3 are disconnected, the sliding contact module 9 is driven towards the tip of the female component 3 by a biasing spring 11*b* which has a higher spring pre-load and stiffness than the central shuttle spring biasing spring 11*a*. However, the biasing spring force closes the opening into housing 13 preventing oil 42 leakage.

The male connector 2 has a centrally mounted contact pin 4 which is insulated along its length. The front portion of the pin is conically formed to provide a centralising feature 48. The pin has a contact band region 25 which engages the socket contact of the mating female connector 3 to form electrical connection 16. A grease filled wiper assembly 5 forms a sealing envelope around the male contact band 25 when disconnected, protecting the male contact band 25 by sealing onto insulation portions, located either side of the contact band 25 region. The male wiper assembly 5 is driven forward when the components 2, 3 are disconnected by the wiper seal spring 6, which has a higher pre-load than the sliding contact module spring 11*b*.

Dielectric oil 42 around the contact module 9 passes from the rear to the front section through vent grooves in the electrical insulator 41. Compensation bladder 49 allows the pin displacement volume to be accommodated as well as thermal temperature variations. Port 50 allows pressure equalisation to the outside environment.

Figure 5:
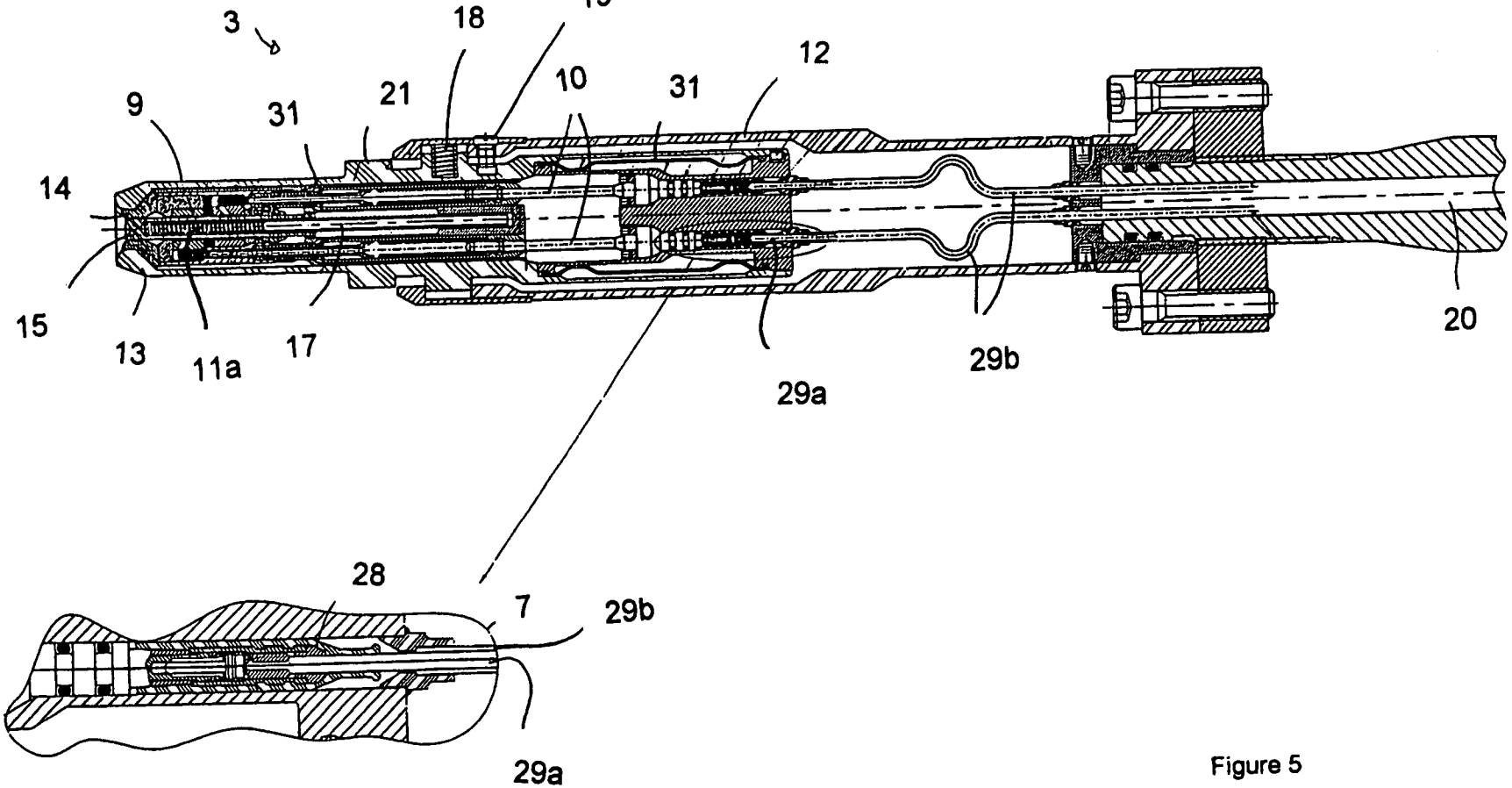
FIG. 5 shows a cross sectional view of the female component of the dual contact sub-sea electrical connector of the present invention.

FIG. 5 illustrates a cross section of the female component 3 of a dual contact sub-sea electrical connector 1. Components corresponding to those in the example of FIG. 1 are numbered identically. In this example the contact module 9 floats within the female housing unit 12. The contact module 9 is centralised prior to engagement by three radial springs 18 which allow a small amount (typically±5 mm) of lateral movement. This lateral flexibility further assists in locating the mating components 2, 3. In order to prevent torsional strain from being introduced in the female component 3, three screws 19 are located in the housing unit 12 to permanently engage the contact module housing 13.

In this example two single wire electrical cables 29*a* are run through steel conduit tubes 29*b* to form a flexible, pressure tight, sealing enclosure which protects the cables 29*a* from the environment yet allows free movement of the contact module housing 13.

The cable termination modules 7, one for each wire 29, and the corresponding sliding contact pins 10 are positioned symmetrically either side of the centre line of the female component 3. A spring support pin 17 is located on the centre line to restrict the compression of the first biassing means 11*a* by the shuttle pin 15, such that the correct positioning of the contact pin 4 is achieved, in use, and suitable electrical connections 16 (FIGS. 10 & 11) can be made. The shuttle pin arrangement translates concentric contacts into sliding contacts which accommodate the longitudinal tolerance.

Figure 6:
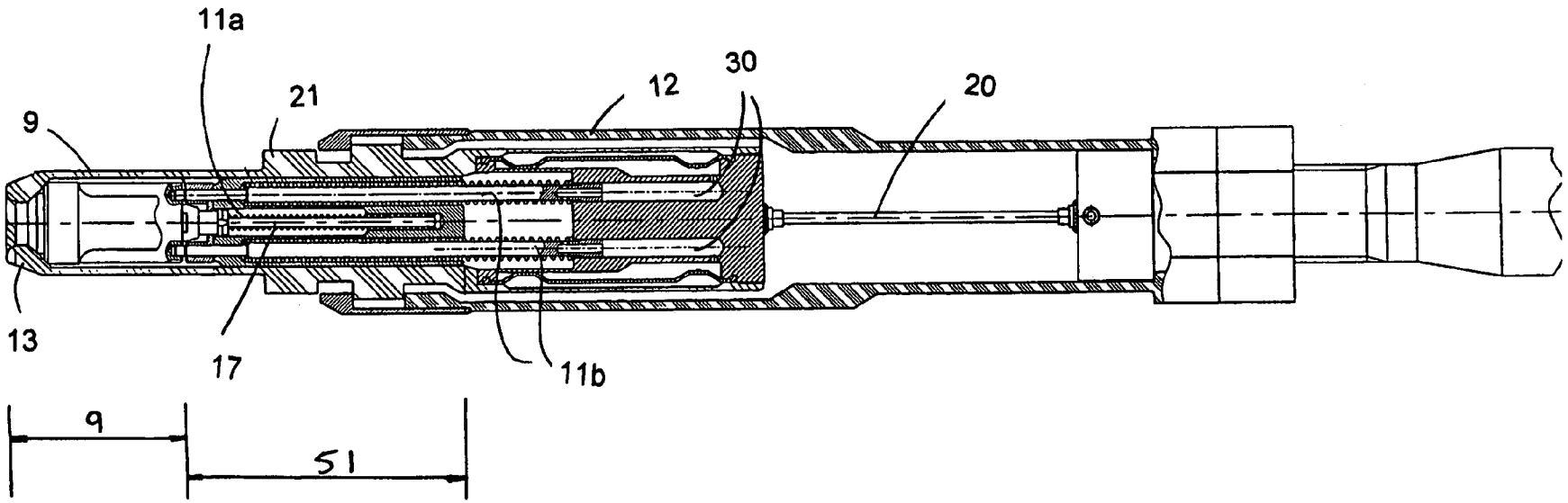
FIG. 6 shows a normal cross section of the view shown in FIG. 5, illustrating the second biassing means of the female component.
Figure 7:
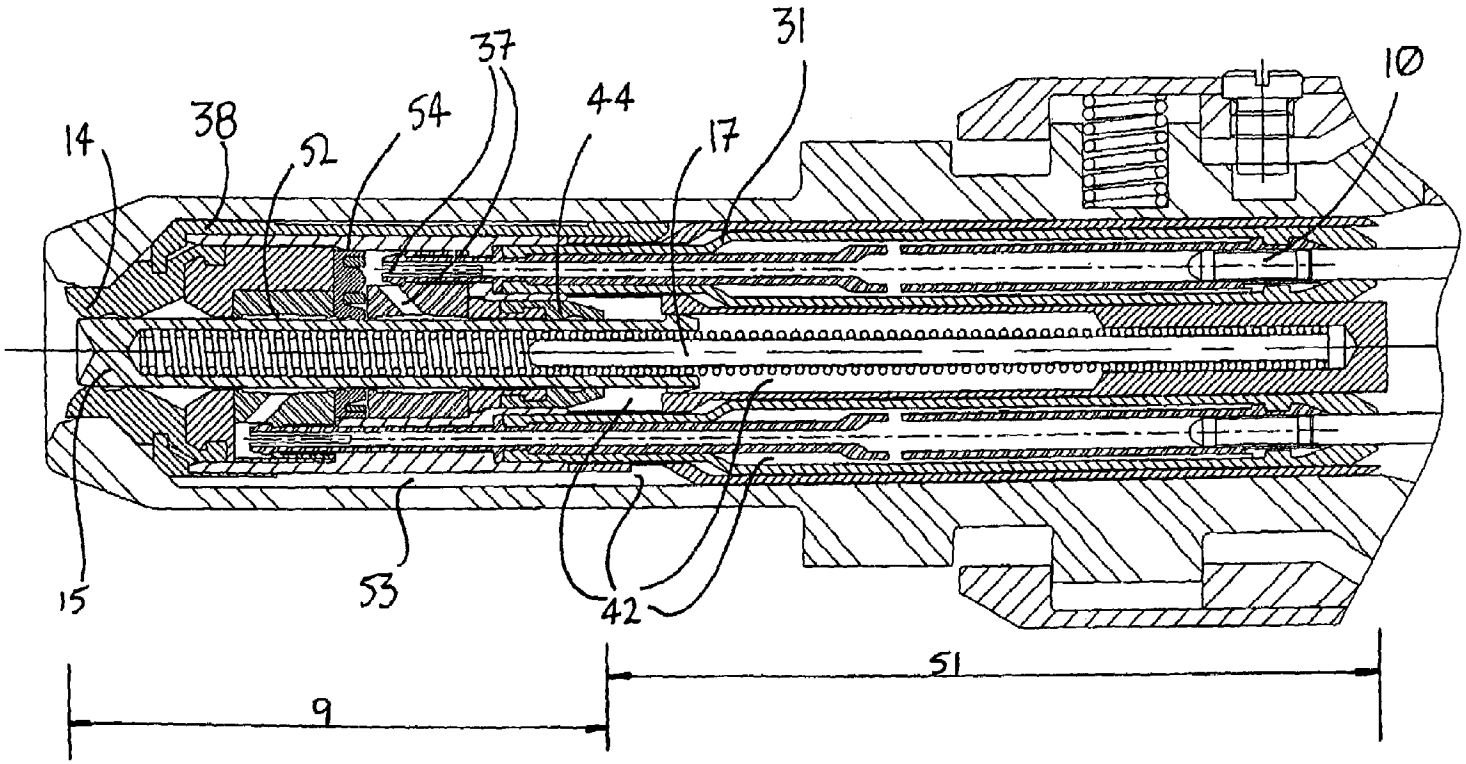
FIG. 7 shows a close up view of the contact and spring modules shown in FIG. 6.

In the dual contact arrangement of this example the second biassing means 11*b* is provided through a second arrangement 30 (FIG. 6), where two springs 11*b* are placed about the centre line of the female component 3 and housed in spring module 51 in an alternative plane to the sliding contact pins 10 (FIG. 5). This second biassing means 11*b* of the spring module 51, which is mechanically linked to contact module 9 through clip 38 (FIG. 7), is set with a higher pre-load than the first biassing means 11*a* to allow shuttle pin 15 to first compress spring 11*a* until it strikes support pin 17 setting the relative contact positions 52 associated with the contact bands 25, 26 on the contact pin 4 of the male component 2. Further longitudinal motion of the contact module 9 allows the wellhead axial tolerances to be achieved whilst maintaining electrical continuity and insulation performance.

Free movement of the internal components of the contact module 9 (FIG. 7) is achieved by allowing the free passage of oil 42 around the spring module 51 and contact module 9 by vent passages 53. Fluid displacement due to the sliding contacts 10 is accommodated by inclusion of diaphragms 31 which also form electrical insulation elements with sliding contact pins 10. The diaphragms 31 independently equalise pressure across each of the contacts through drillings 37 which feed contact cavities created by front wiper seal 14, rear wiper seal 44 and intermediate seal 54. Thus both contacts are effectively independent and electrically isolated from each other and earth at all times.

Figure 8:
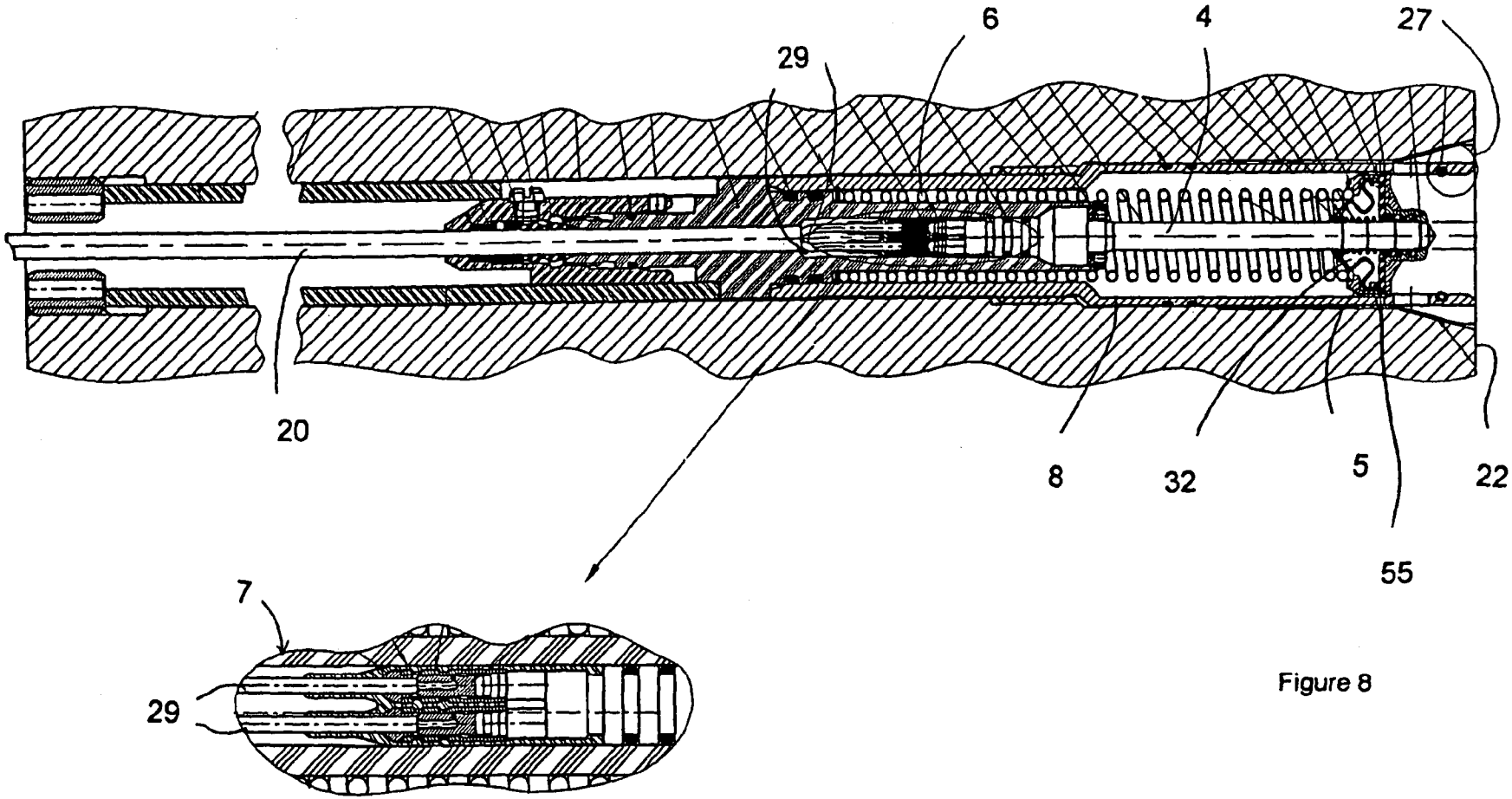
FIG. 8 shows a cross sectional view of the male component of the dual contact sub-sea electrical connector of the present invention.
Figure 9:
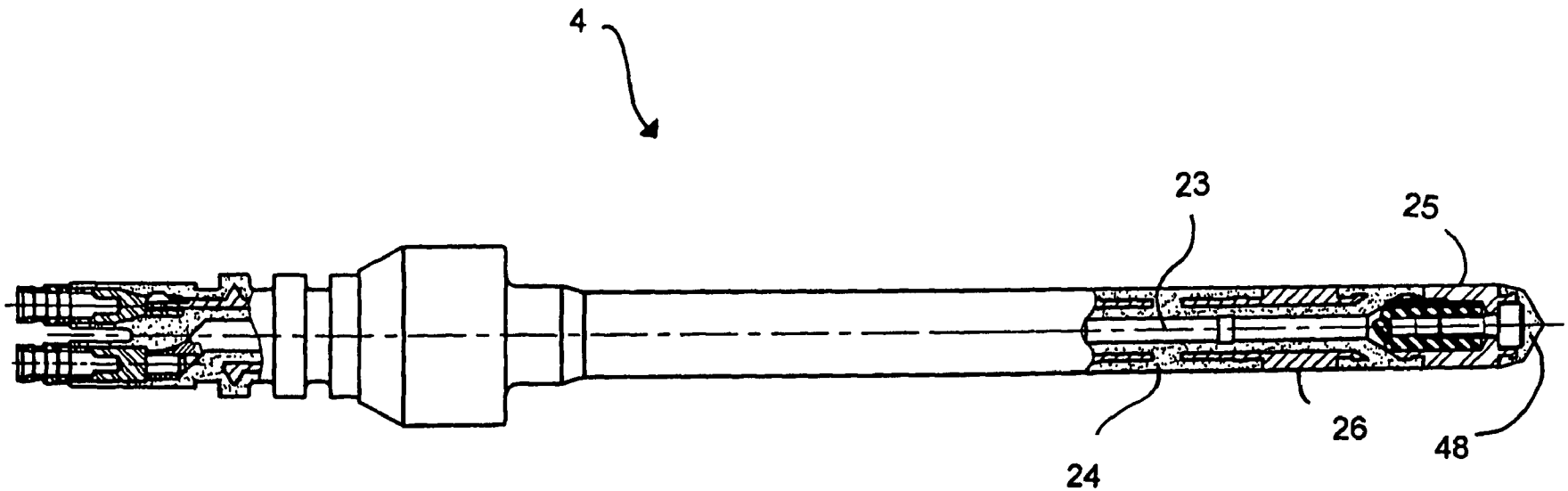
FIG. 9 shows the contact pin from FIG. 8 in greater detail.

The male component 2 of the dual contact example of the present invention is illustrated in FIGS. 8 and 9. Prior to engagement with the female part 3, the contact bands 25, 26 of the contact pin 4 are enveloped and sealed by a telescopic wiper assembly 5. This wiper assembly 5 is retained in place by an abutment in housing 8 and wiper spring mechanism 6 which surrounds the remainder of the contact pin 4 and the cable termination module 7. The wiper assembly 5 is filled with electrically insulating grease or similar substance 32 and, in use, wipes and lubricates the contact pin 4 to remove any trace of water and/or silt from the surface of the contact pin 4, thus ensuring a better electrical connection 16. Four vent ports 27 with ejection slots are located within face 22 of the male component 2 for water and sand ejection during coupling.

The contact pin 4 is shown in greater detail in FIG. 9. The wiper 5 profile provides a mechanical, axial alignment feature during coupling forming a location and sealing arrangement with housing 13. Two separate insulated contacts 16 are provided in pin 4 by arranging a central conductor rod 23 concentrically within an outer conductor tube 24. The contact of the inner rod 23 being located in a band 25 at the tip of the pin 4 and the second contact band 26 being located further down the length of the pin 4 and insulated from the first band 25. Each band 25, 26 feeds back to a single wire 29 at the cable termination module 7 via the copper alloy conductor rods 23, 24.

Figure 10A:
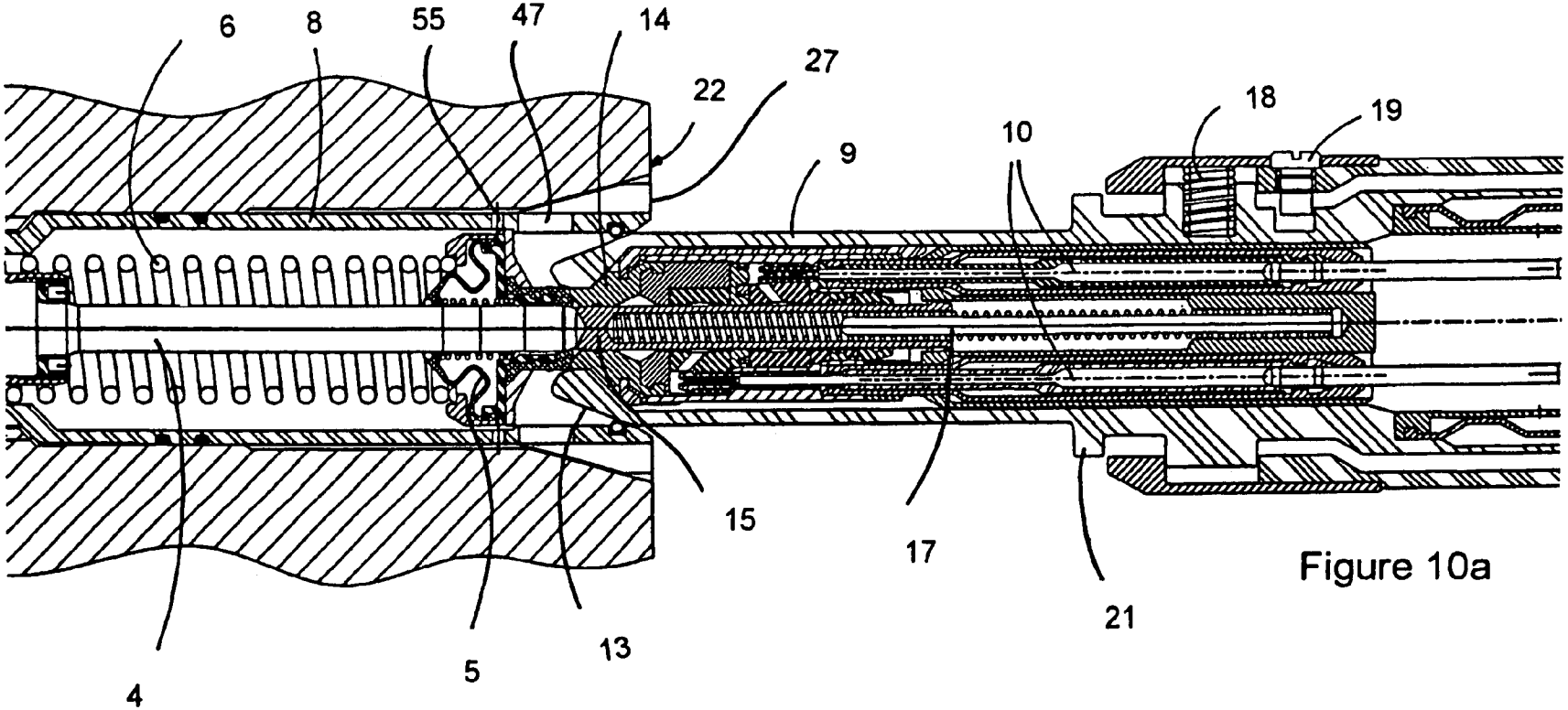
FIG. 10 shows a cross sectional view of three stages of the engagement operation of the dual contact, sub-sea, electrical connector.
Figure 10B:
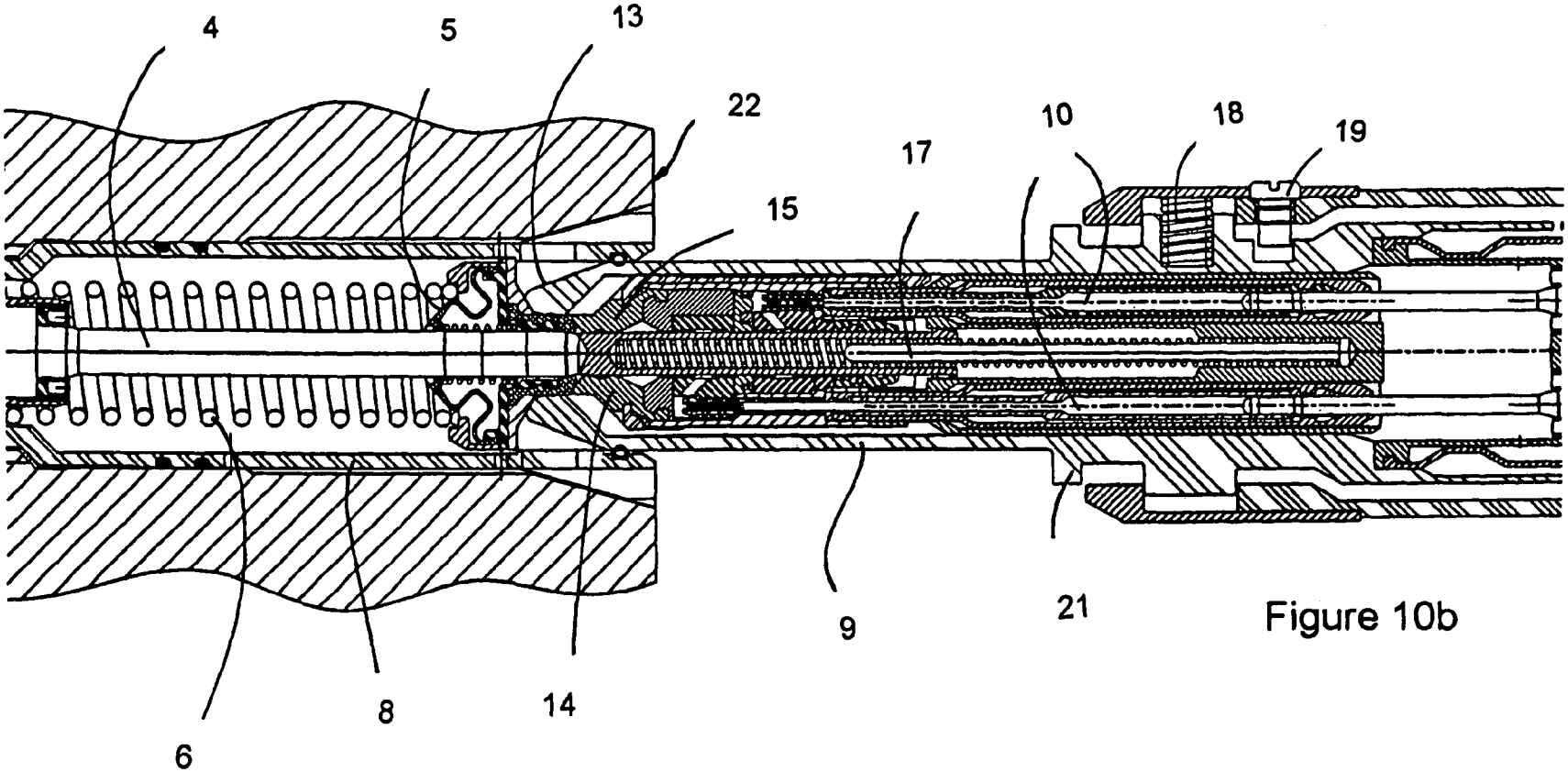
Figure 10C:
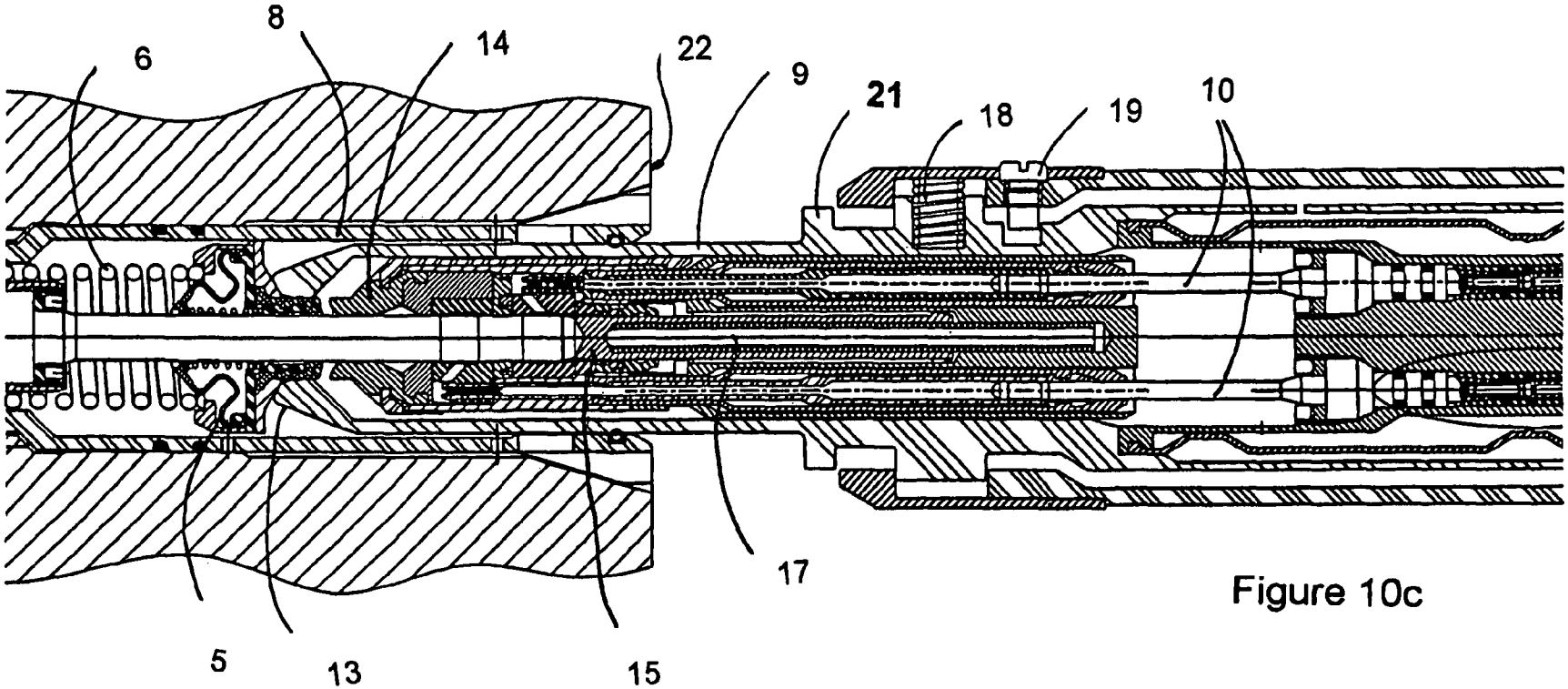

FIGS. 10*a* to 10*c* illustrate engagement of the male 2 and female 3 components of the dual contact electrical connector 1, which is similar to the single contact connector of FIG. 1.

The concentric design of the connector 1 allows it to be used at any rotational orientation, thus simplifying the coupling and mounting operations. In use, the male 2 and female 3 components are brought together and the wiper diaphragm seal 14 of the female component 3 engages the contact pin 4 of the male component 2 excluding water at the contact face by virtue of the elastomer seals and spring forces. This water, along with any sand and silt borne in it, is flushed through ports 27 and 47. As the coupling process is further advanced a secondary port 55 provides a pathway to the primary ports 27, 47 for further water to be ejected. As the longitudinal motion continues the tip of the housing 13 moves from resting on the wiper diaphragm seal 14 to be located on and form a seal with the wiper assembly 5 of the male component 2, whilst maintaining the seal between the housing 13 and its adjacent component 14, 5 (FIG. 10*a* to 10*b*). In this way a continuous contact protection envelope is established prior to engagement of the contacts 16. The tip 48 of the contact pin 4 passes through the wiper diaphragm seal 14 and mates with the contact module 9 at the tip of the shuttle pin 15. Once the transfer of housing 13 is complete, further motion causes the housing 13 to force the wiper assembly 5 along the contact pin 4 and the wiper spring mechanism 6 is compressed (FIG. 10*b* to 10*c*). The corresponding motion of the shuttle pin 15 caused by the contact pin 4 compresses the first biassing means 11*a* until the motion is restricted by the spring support pin 17 (FIG. 10*c*). At this level of penetration, the relative positions of the contact module 9 and the contact pin 4 are such that an electrical connection 16 is established between the two. At this point, minimum engagement can be said to have been achieved.

Due to the sliding contact pin 10, the second biassing means 11*b* of the female component 3 (see FIG. 6) and the distance between the collar 21 of the female component 3 and the face 22 of the male component 2, there remains a degree of travel in the longitudinal sense. This margin accommodates the large tolerances that may be required in conditions associated with sub-sea well head connections/equipment (not shown). Maximum engagement is illustrated in FIG. 11 where collar 21 is in direct contact with face 22 of the male component 2. This level of engagement provides the additional feature of enhancing the dissipation of the engagement loads through the housing components 8, 12 protecting the male contact pin from severe end loads.

The invention claimed is:

1. An electrical connector, for use in underwater applications, the connector comprising a male component having at least one contact pin and a wiper assembly that telescopes in length, and a female component having a contact module, the male and female components engaging, in use, to form a watertight electrical connection between the at least one contact pin and the contact module, the female component further comprising a biassing module, the biassing module comprising a first biassing means and a second biassing means, the first biassing means having a different resilience to that of the second biassing means such that the biassing strength of the biassing module can be tailored to control the insertion rate of the male component during engagement of the male component and the female component; and wherein two electrical contacts are formed between the at least one contact pin and the contact module: and the at least one contact pin is formed from two conducting sections insulated from one another, the first section lying inside the second section.

2. An electrical connector according to claim 1, wherein one or more of the biassing means are springs.

3. An electrical connector according to claim 1 wherein the first biassing means is located radially within the second biassing means with respect to the longitudinal axis of the female component.

4. An electrical connector according to claim 1 wherein the contact module and the biassing module are located within an oil-filled chamber.

5. An electrical connector according to claim 1 wherein the contact module is accurately seated on the end of the contact pin.

6. An electrical connector according to claim 1, wherein the wiper assembly, in use, provides a seal between the contact pin and the contact module, whilst assisting with the axial alignment of the components during engagement.

7. An electrical connector according to claim 1, wherein the wiper assembly is filled with electrically insulating grease.

8. An electrical connector according to claim 1, wherein the female component comprises a female wiper assembly that remains energised on disconnection of the male component.

9. An electrical connector according to claim 1, wherein, in use, at least one contact pin or a sliding element of the contact module is connected to a cable by a crimping assembly.

10. An electrical connector according to claim 9, wherein the crimping assembly latches and locks upon insertion of a cable, crimping the contact pin or sliding element by movement of a sealing boot associated therewith.

11. An electrical connector according to claim 1 wherein a single electrical contact is formed between the at least one contact pin and the contact module.

12. An electrical connector according to any of the preceding claims, wherein the female component comprises a housing unit and the contact module floats radially within the housing unit and is centralized therein by a biassing means which compensates for radial misalignment.

13. An electrical connector according to claim 12, wherein retaining members are located in the housing unit to permanently engage the contact module such that torsional strain is prevented within the female component.

* * * * *